US009328904B2

(12) United States Patent
Volkenand et al.

(10) Patent No.: US 9,328,904 B2
(45) Date of Patent: May 3, 2016

(54) LIGHTING DEVICES RETROFITTABLE ON MEDICAL DEVICE SUPPORT SYSTEMS

(75) Inventors: Kai Volkenand, Hünfeld (DE); Stefan Perplies, Hünfeld (DE); Fritz Ickler, Kirchheim (DE)

(73) Assignee: Ondal Medical Systems GmbH, Hüfeld (DE)

( * ) Notice: Subject to any disclaimer, the term of this patent is extended or adjusted under 35 U.S.C. 154(b) by 493 days.

(21) Appl. No.: 13/510,891

(22) PCT Filed: Nov. 18, 2010

(86) PCT No.: PCT/EP2010/007021

§ 371 (c)(1),
(2), (4) Date: Jul. 27, 2012

(87) PCT Pub. No.: WO2011/060941

PCT Pub. Date: May 26, 2011

(65) Prior Publication Data

US 2013/0044483 A1 Feb. 21, 2013

(30) Foreign Application Priority Data

Nov. 18, 2009 (DE) ..... 10 2009 053 713

(51) Int. Cl.
*F21V 33/00* (2006.01)
*F21V 21/34* (2006.01)
(Continued)

(52) U.S. Cl.
CPC ..... *F21V 21/34* (2013.01); *A61G 13/107* (2013.01); *F21S 4/003* (2013.01); *F21V 21/088* (2013.01); *F21V 21/26* (2013.01);
(Continued)

(58) Field of Classification Search
CPC ... F21V 21/02; F21V 33/0068; F21V 21/088; F21W 2131/20; F21S 4/003; A61C 1/088; A61B 1/06; A61B 1/0607; A61B 1/0623
USPC ..... 362/147, 249.01
See application file for complete search history.

(56) References Cited

U.S. PATENT DOCUMENTS 4,475,322 A 10/1984 Russo et al.
2009/0080190 A1* 3/2009 Bauer et al. ..... 362/235
(Continued)

FOREIGN PATENT DOCUMENTS

CN 201312924 Y 9/2009
DE 297 03 165 U1 6/1997
(Continued)

*Primary Examiner* — Karabi Guharay
(74) *Attorney, Agent, or Firm* — Seed IP Law Group PLLC

(57) ABSTRACT

The invention refers to a lighting device (10) for a support or supply system (T) for medical-electrical devices, respectively, having:
- a light rack (1) for carrying an illuminant (2),
- at least one illuminant (2) attached to the light rack,
- a light cover (3) for covering the illuminant, and
- fixing means (4) for fixing the rack (1) to the medical support or supply system, respectively, wherein an assembly of the light rack (1), the at least one illuminant (2), and the light cover (3) generates a flat and space-saving profile for the lighting device (10), and wherein the lighting device (10) is designed for being retrofitted on a substantially horizontal surface of the support or supply system (T), respectively, to serve as floor lighting or ceiling lighting.

17 Claims, 10 Drawing Sheets

(51) Int. Cl.

| | |
|---|---|
| ***A61G 13/10*** | (2006.01) |
| ***F21S 4/00*** | (2016.01) |
| ***F21V 21/088*** | (2006.01) |
| ***F21V 21/26*** | (2006.01) |
| *F21W 131/20* | (2006.01) |
| *F21Y 101/02* | (2006.01) |
| *F21Y 103/00* | (2016.01) |
| *F21Y 105/00* | (2016.01) |

(52) U.S. Cl.
CPC ..... *F21V 33/0068* (2013.01); *F21W 2131/20* (2013.01); *F21Y 2101/02* (2013.01); *F21Y 2103/003* (2013.01); *F21Y 2105/001* (2013.01)

(56) References Cited

U.S. PATENT DOCUMENTS

| | | | | |
|---|---|---|---|---|
| 2009/0189165 | A1 | 7/2009 | Song | |
| 2009/0196023 | A1 * | 8/2009 | Heiking et al. ..... | 362/147 |

FOREIGN PATENT DOCUMENTS

| | | | |
|---|---|---|---|
| DE | 203 10 780 | U1 | 1/2004 |
| DE | 20 2005 016 891 | U1 | 4/2007 |
| DE | 20 2007 015 939 | U1 | 4/2009 |
| EP | 1 026 443 | A1 | 8/2000 |
| EP | 2 039 984 | A1 | 3/2009 |
| FR | 985166 | | 4/1949 |

* cited by examiner

LIGHTING DEVICES RETROFITTABLE ON MEDICAL DEVICE SUPPORT SYSTEMS

BACKGROUND OF THE INVENTION

The present invention refers to a lighting device, and in particular to a retrofitable lighting device.

The lighting device according to the invention is suitable or adapted, in particular, to be retrofitted to a support system or to a supply console for medical end devices, respectively. Thus, the invention refers to retrofitable lighting devices for medical support systems and supply consoles.

Support systems and supply consoles for medical-electrical end devices are frequently used in the clinical field, in particular in hospitals (e.g. in operating theatres and in intensive care units) and in doctor's practices. An existing problem with medical care of patients is providing suitable lighting that does not inconvenience the patients, but that provides nevertheless sufficient light for the staff (i.e. doctors and nurses) enabling them to carry out their work in a reasonable and comfortable way.

Even though patients in intensive care units usually sleep in darkened rooms at night, the doctors and nurses continue their work of course. This includes surveillance of the medical devices and the patients themselves. Also in operating theatres sometimes dimed light is applied, e.g. in order to optimally reveal endoscopic examination radiation and/or examination pictures during an operation. Since patient care does not always take place in a brightly illuminated environment, in medical practice there often exists the need for indirect or specifically targeted light. It is the aim of the invention to meet this need with practical, flexible and customized solutions.

BRIEF DESCRIPTION OF THE INVENTION

This aim is achieved by a lighting device according to claim 1. Preferred embodiments of the invention result from the features of the dependent claims.

According to one aspect, the invention provides a lighting device having the following features:

a light rack for carrying an illuminant, at least one illuminant attached to the light rack, a light cover for covering the illuminant, and fixing means for retrofitable fixation of the rack to the support or supply system, respectively.

The fixing means is suitable or adapted for fixing the rack and/or the light cover to a surface of the support or supply system, respectively. The fixing means may comprise screws used screwing the light rack and/or the light cover securely on the support system, e.g. on a support arm, or on the supply console. Preferably, the fixing means comprise one or several clips being adapted for releasable fixation to a component (e.g. to a cylindrical component, such as a rod or a tube) of the support or supply system, respectively. Each clip may be constructed such that it enables the lighting device to move along a longitudinal axis of the component and/or to rotate around this longitudinal axis. Preferably, each clip in connection with the component can engage or disengage (e.g. with a "click"). The clip preferably comprises flexible or elastically stretchable grippers which can, at least partially, encompass the component.

In a preferred embodiment of the invention, an assembly of the light rack, the illuminant, and the light cover exhibits a flat profile, so that the lighting device can be fixed to a flat surface of the support or supply system, respectively, in a space-saving fashion and without attracting attention. The light rack preferably comprises a board, plate, and/or film supporting the lighting device on the support or supply system, respectively. The board, plate or film can be provided with a reflecting surface in order to efficiently radiate the light produced by the illuminant into the room.

The light cover preferably has a flat profile and extends over a substantial circumference of the at least one illuminant and/or the light rack. The light cover consists of a translucent or transparent material, such as crystal or, further preferred, plastic. The light cover is preferably provided with a layer or a structure generating a scattered illumination or a diffuse light, respectively.

In a preferred embodiment of the invention, the at least one illuminant comprises at least one luminous element, such as a light-emitting diode. Of course, the lighting device may comprise several illuminants or light-emitting diodes, and preferably, these also have a relatively flat profile. For example, the illuminants or light-emitting diodes may be integrated within a flat strip. Such strips are preferably flexible and may further be rollable. The strips have, for example, a width in the range of approximately 5 mm to 15 mm and a thickness in the range of approximately 1 mm to 3 mm.

According to one aspect, the invention provides a retrofitable lighting device for a medical-electrical support or supply system, respectively, having a light rack or housing for carrying an illuminant, at least one illuminant attached to the light rack or housing, respectively, a light cover for covering the illuminant, and fixing means for fixing the lighting device to a surface of the support or supply system, respectively.

In a preferred embodiment of the invention, the lighting device or the light rack thereof is adapted for being retrofitted on or at a substantially horizontal surface of the support or supply system, respectively, in particular at a lower surface of a supply console, the lower surface facing the floor, or, alternatively, at an upper surface of a support arm or boom of the support system, the upper surface facing the ceiling. In such an embodiment, the at least one illuminant and its light cover are designed to generate an illumination with an angle of radiation of less than approximately 180°, and preferably of approximately 120°. Thus, the lighting device according to the invention may be designed either as a ceiling lighting or floor lighting.

In a preferred embodiment of the invention, the lighting device comprises a control unit allowing controlling the lighting device, in order to turn it on or off and/or to change its light intensity. In other words, the control unit can regulate the power of the at least one illuminant, in order to reduce (i.e. to "dim" or damp) the lighting of the lighting device or, if necessary, to raise it again. In such an embodiment, the control unit may comprise a potentiometer to regulate the light intensity of the lighting device. The control unit is preferably housed within an operating module of the lighting device. The operating module may be integrated with the light rack or within the housing of the lighting device and/or may be provided as remote control.

According to another aspect, this invention provides a support system or a supply console, respectively, for medical-electrical devices, wherein the support system or the supply console, respectively, comprises a lighting device according to the invention. Preferably, the lighting device is attached to the support system or supply console, respectively, in such a way that it generates an indirect illumination.

BRIEF DESCRIPTION OF THE DRAWINGS

Further preferred embodiments of the invention result from the following description of embodiments with reference to the attached Figures, wherein components having the same function or having similar functions are provided with the same reference signs.

DESCRIPTION OF THE EMBODIMENTS OF THE INVENTION

Figure 1:
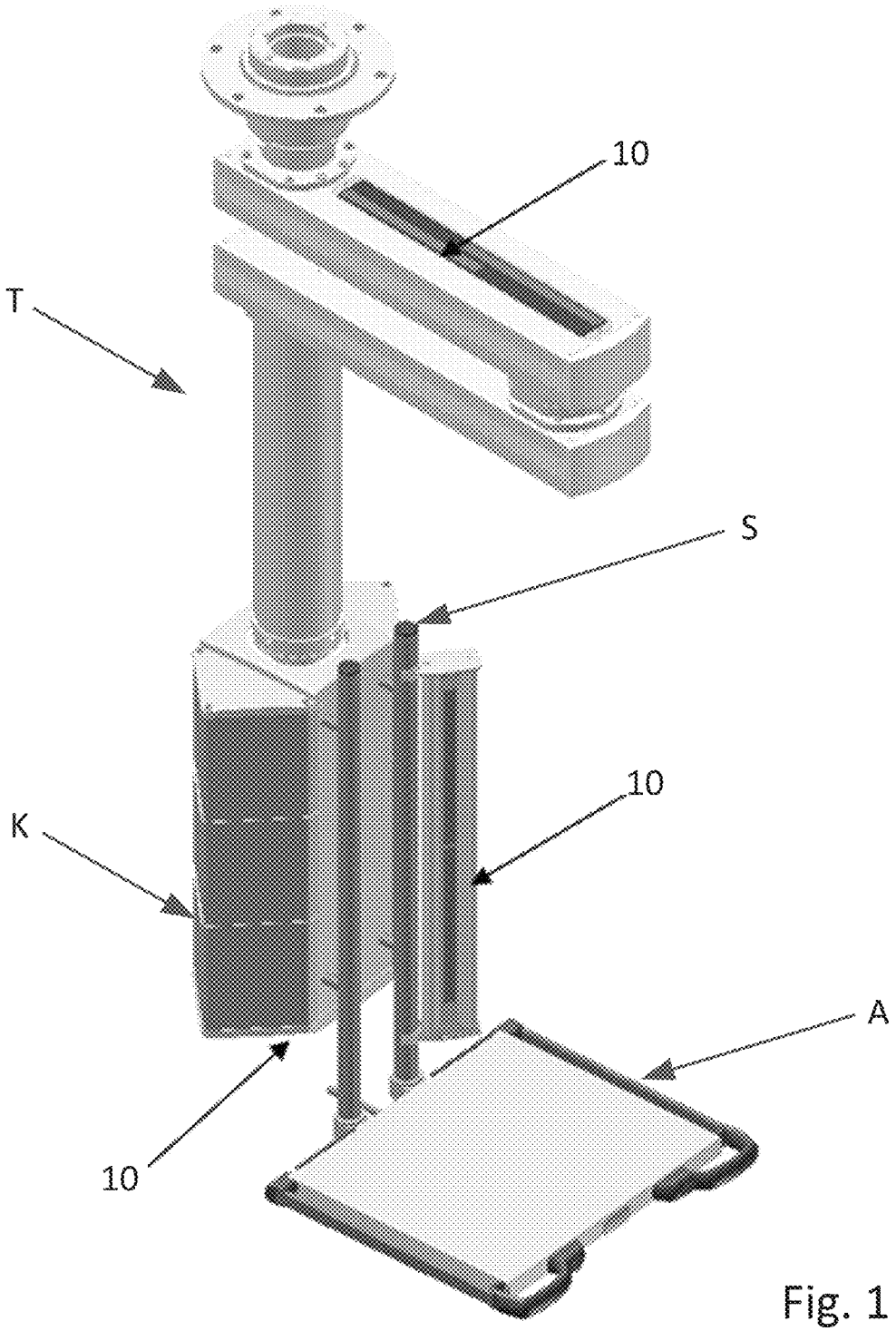
FIG. 1 shows a perspective view of a support system with a supply console, provided with lighting devices according to embodiments of the invention.

FIG. 1 shows a support system T according to the invention in the form of a ceiling mount for installation in a medical treatment room (e.g. in an operating theatre or in an intensive care unit) in a hospital. The ceiling mount has a supply console K for medical-technical supply (e.g. with current, gas, communication technique) of medical-electrical (ME) end devices that are typically held and supported by one or several trays A. Three lighting devices 10 according to the invention have been retrofitted to the support system T. In other words, these lighting devices 10 are designed such that they are adapted for retrofitting to support systems that have already been installed in hospitals or doctor's practices. The lighting devices 10 can be attached and fixed easily.

Figure 2:
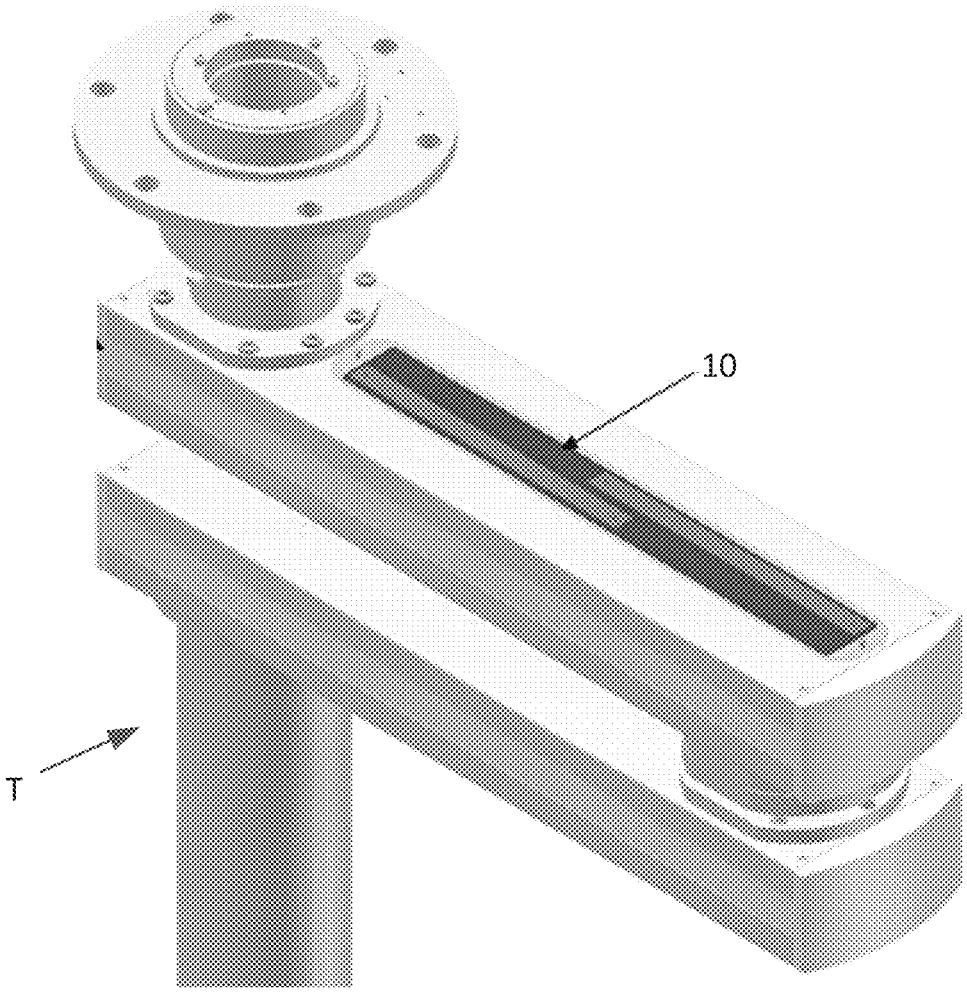
FIG. 2 shows a perspective partial view of the support system of FIG. 1 with a retrofitted lighting device according to an embodiment of the invention.
Figure 3:
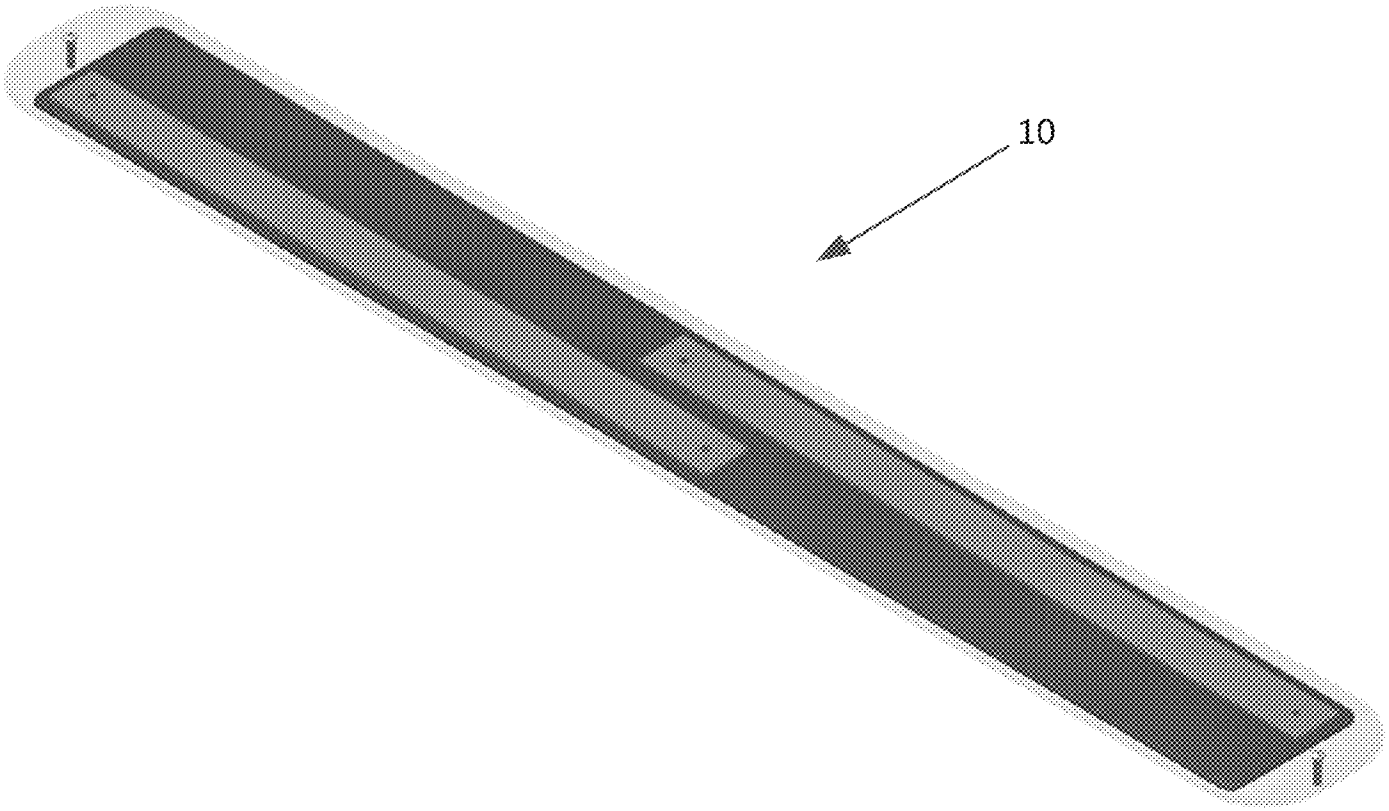
FIG. 3 shows a perspective view of the lighting device shown in FIG. 2.
Figure 4:
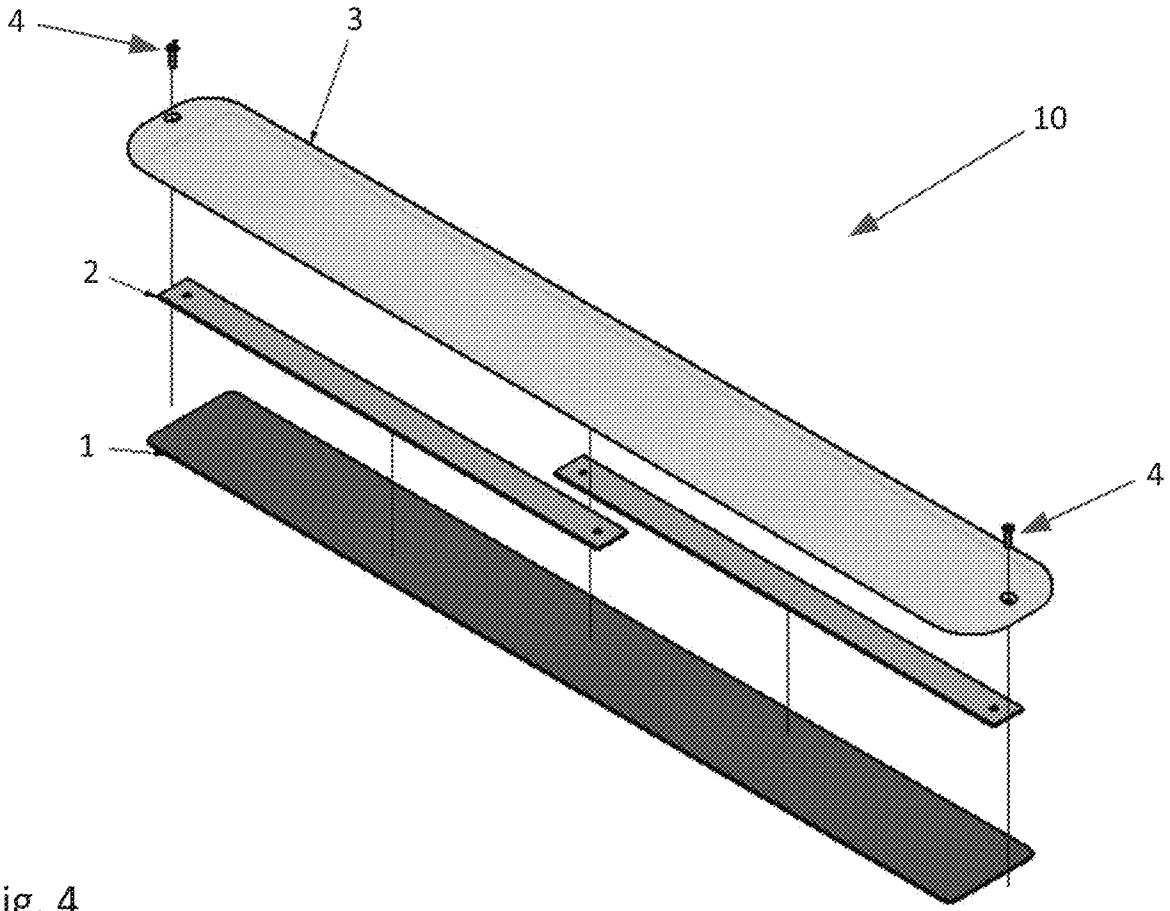
FIG. 4 shows an exploded view of the lighting device shown in FIG. 3.

FIGS. 2-4 show a first embodiment of a lighting device 10 according to the invention for indirect illumination of the room (in this case by means of a ceiling lighting) in the darkened room to create an orientation possibility without any disturbing illumination in the region of activity.

In the first example, the lighting device 10 is constructed such that, by using an electrical voltage source (line current or accumulators, respectively), it generates an indirect lighting toward the room ceiling via an illuminant, wherein the indirect illumination helps to ensure, for example, lighting for orientation in darkened operating theatres. Two illuminants 2 are fixed (e.g. by gluing, soldering, screwing, bolting, riveting) onto an elongate illuminant holding fixture or an elongate light rack 1, respectively. The light intensity of the illuminants 2 can be provided with a varying amount and arrangement of luminous elements, according to the required lighting conditions. In this example, the illuminants 2 consist of light-emitting diodes (LEDs) which are integrated into two flexible rollable strips. The strips have a width of approximately 8 mm and a thickness of approximately 1.5 mm and comprise 60 LEDs connected in two series. The LEDs have a light intensity of 120 lumen, an angle of radiation of approximately 120° and a chromaticity coordinate of X 0.41, Y 0.42. A voltage supply (preferably 24 Volt) being installed within or external, respectively, to the support system ensures the electrical supply of the illuminants 2.

Covering the light rack 1 and illuminants 2 is performed with an elongate and relatively flat (e.g. slightly curved) light cover 3. The cover 3 fulfills two objects. The primary object is the reduction of the light intensity to create an indirect light. For this purpose, clouded plates with different grades of transmission or plates applied with a grid structure for scattered light may be used, respectively. Alternatively, the light intensity of the lighting device can be regulated with a potentiometer. The light cover 3 can be designed such that the light rack 1 and the illuminants 2 are fixed in the cover 3 or that the definition of their orientation may be carried out with additional components, respectively. The fixation of the entire device to the support system is carried out by fixing means 4. For example, screws, pins, bolts, clips, glue or other constructive fixing solutions are suitable as fixing material.

Figure 5:
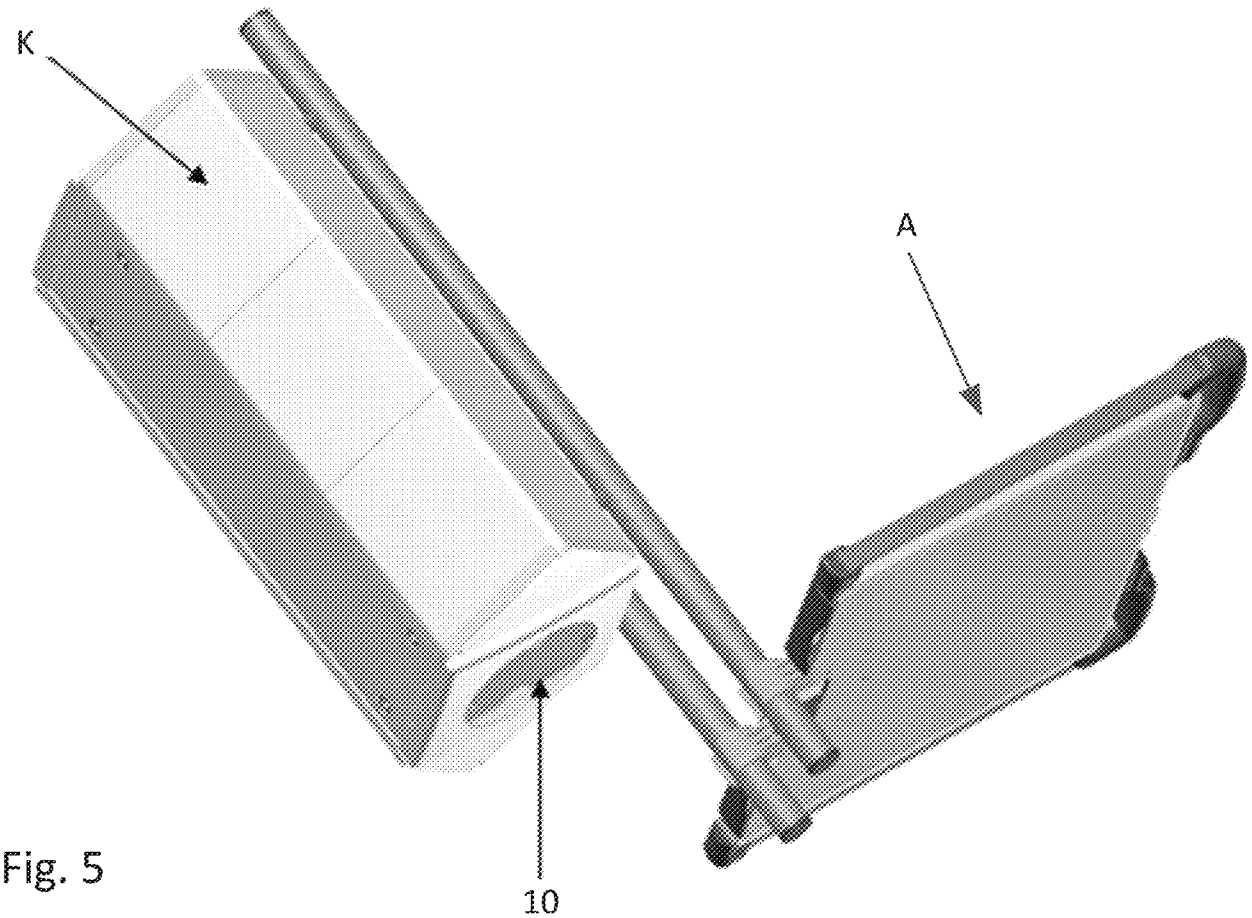
FIG. 5 shows a bottom view of the supply console shown in FIG. 1 with a lighting device according to an embodiment of the invention.
Figure 6:
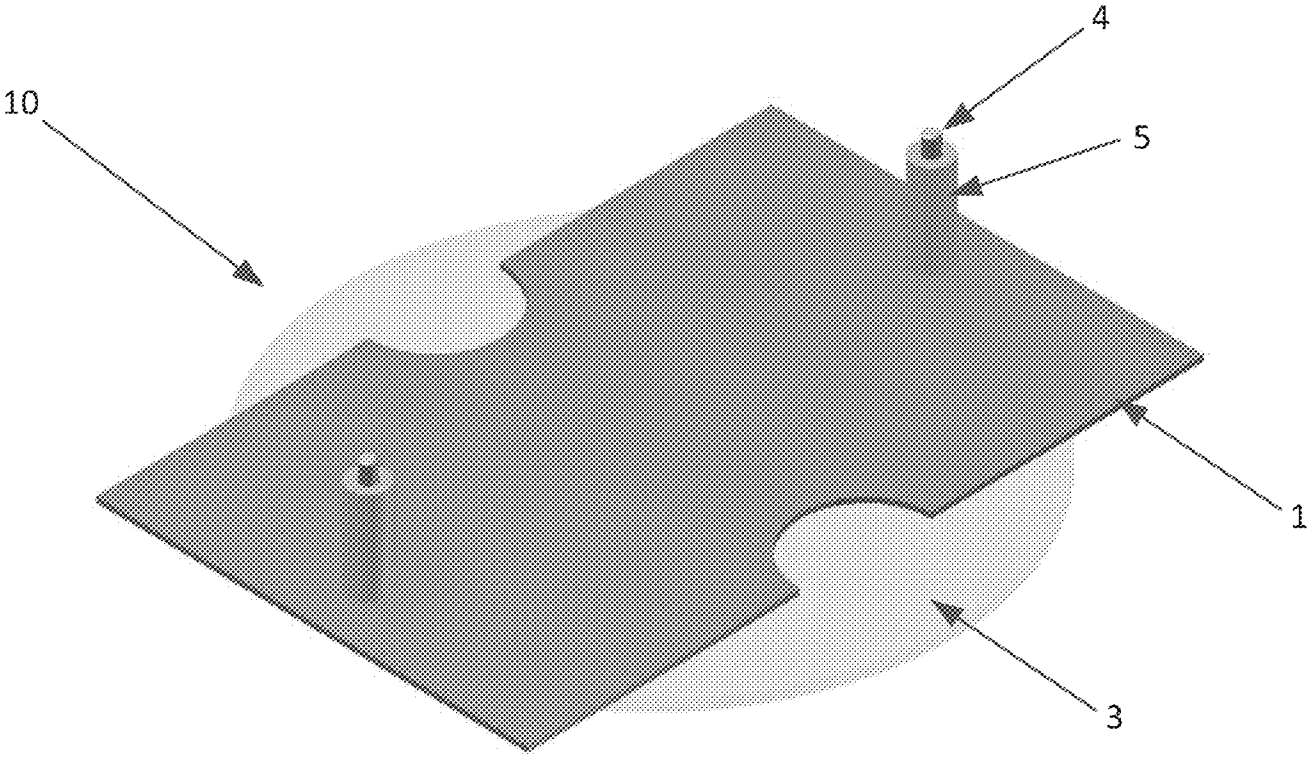
FIG. 6 shows a perspective view of the lighting device shown in FIG. 5.
Figure 7:
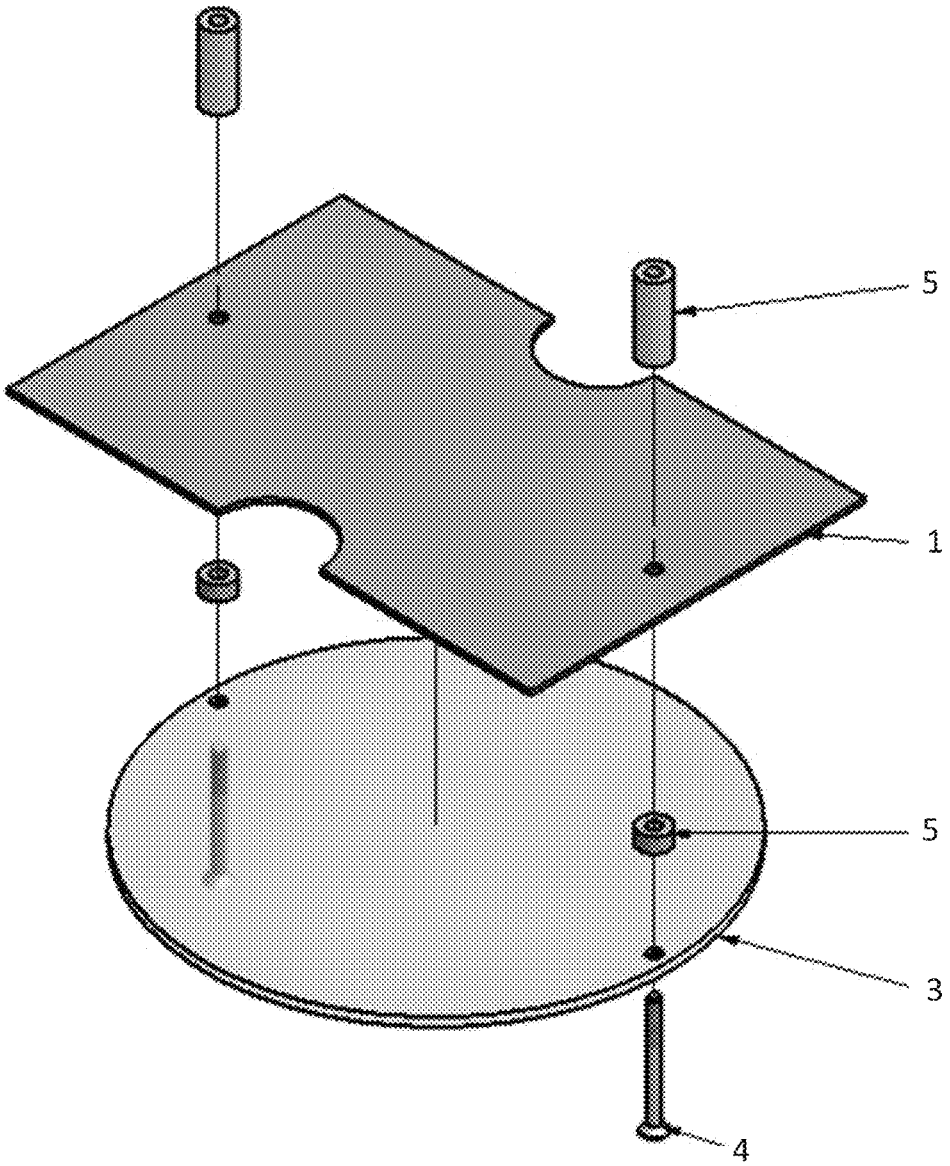
FIG. 7 shows an exploded view of the lighting device shown in FIG. 6.

FIGS. 5-7 show a second embodiment of a retrofitable lighting device 10 according to the invention for indirect lighting of the room (in this case as floor lighting). This lighting device 10 is attached to a lower side of the supply console K and is constructed such that an indirect lighting towards the floor is generated by several illuminants 2 using an electrical voltage supply (line current or accumulators, respectively), wherein the indirect lighting helps to ensure, for example, lighting for orientation in a darkened operating theatre, but without disturbing lighting in the region of operation.

The flat light rack or illuminant holding fixture 1 represents the basis of the retrofitable indirect lighting. The rack 1 can comprise a plate or a reflecting strip (made from sheet metal, plastic, etc.) provided with commercially available illuminants 2. The light intensity of the lighting device can be provided with a varying amount and arrangement of illuminants 2 according to the required lighting conditions. In the present embodiment, the illuminants 2 (not shown in FIGS. 6 and 7) comprise a number in the region of from 3 to 10 LEDs which are attached to the lower side of the plate 1. Together the LEDs have the following properties: Light intensity of 225 lumen, colour temperature of 5600 K, colour rendering index of 80, and angle of radiation of approximately 120°.

The distance between the illuminants 2 and the supply console K, as well as between the illuminants 2 and the flat, circular cover 3 is ensured by spacers 5, in order to isolate these parts from the heat generated in the illuminant 2. As mentioned above, the cover 3 fulfills two objects. The primary object is the reduction of the light intensity to generate an indirect light. For this purpose, clouded plates with different grades of transmission or plates provided with a grid structure for scattered lighting can be used, respectively. Alternatively, the light intensity of the lighting device can be regulated by a potentiometer. Fixation of the plate 1 and the cover 3 to the supply console K is carried out with corresponding fixing material 4. For example, the fixation can be carried out by screws, pins, bolts, glue or similar measures.

Figure 8:
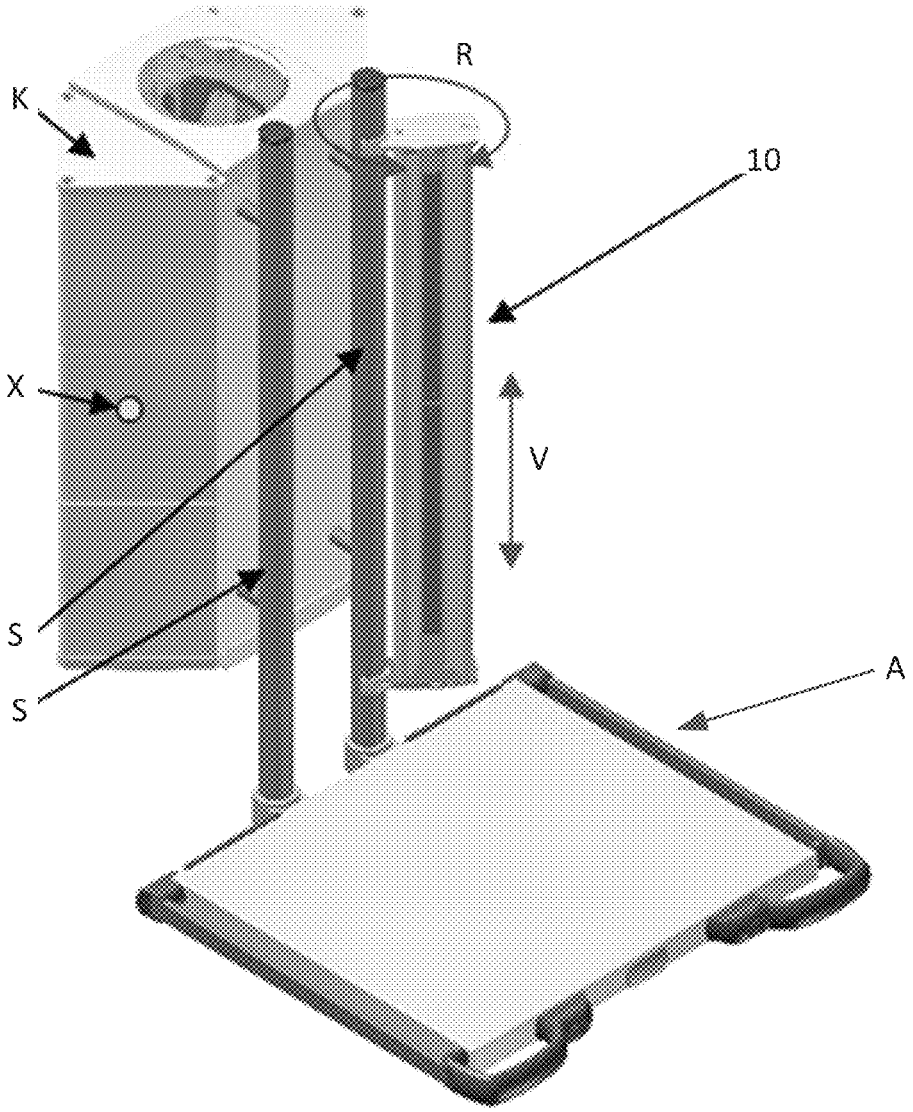
FIG. 8 shows a perspective view of the supply console shown in FIG. 1 with a lighting device according to further embodiment of the invention.
Figure 9:
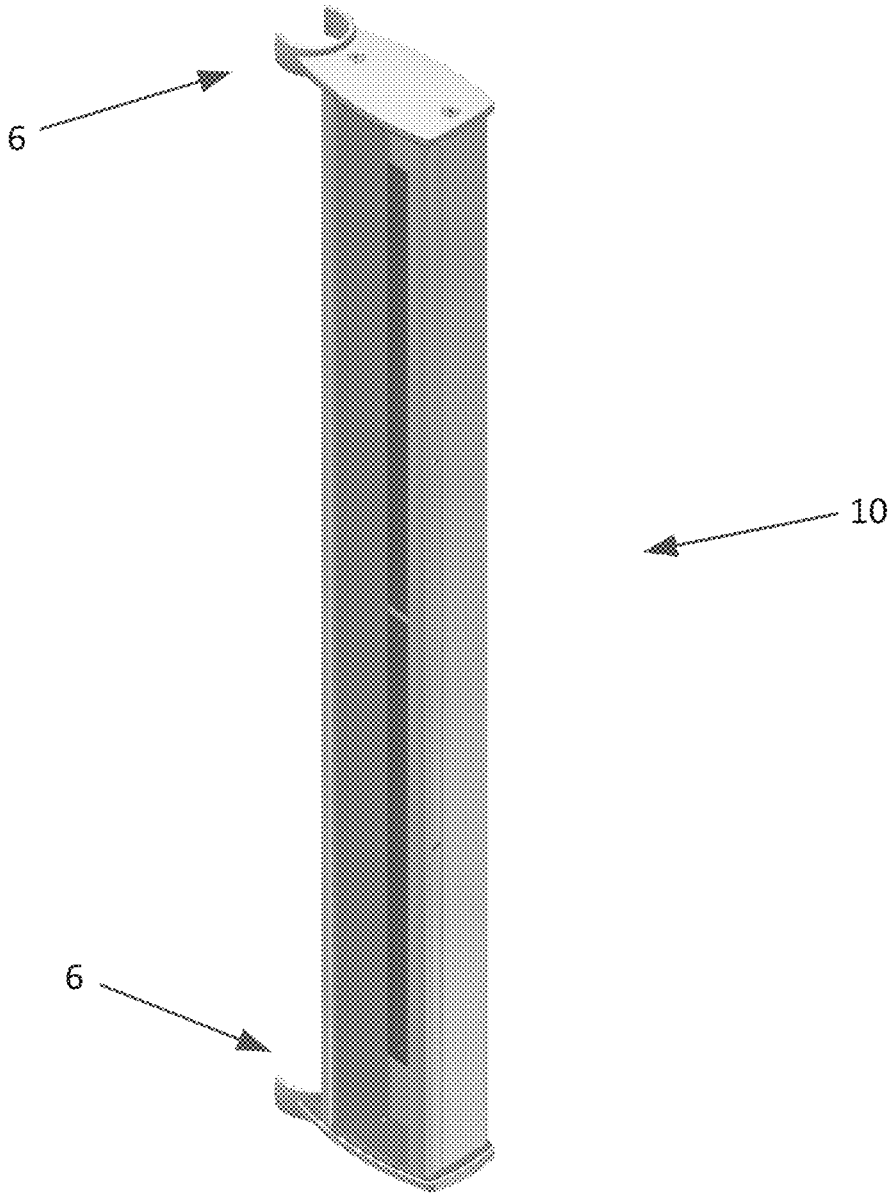
FIG. 9 shows a perspective view of the lighting device shown in FIG. 8.
Figure 10:
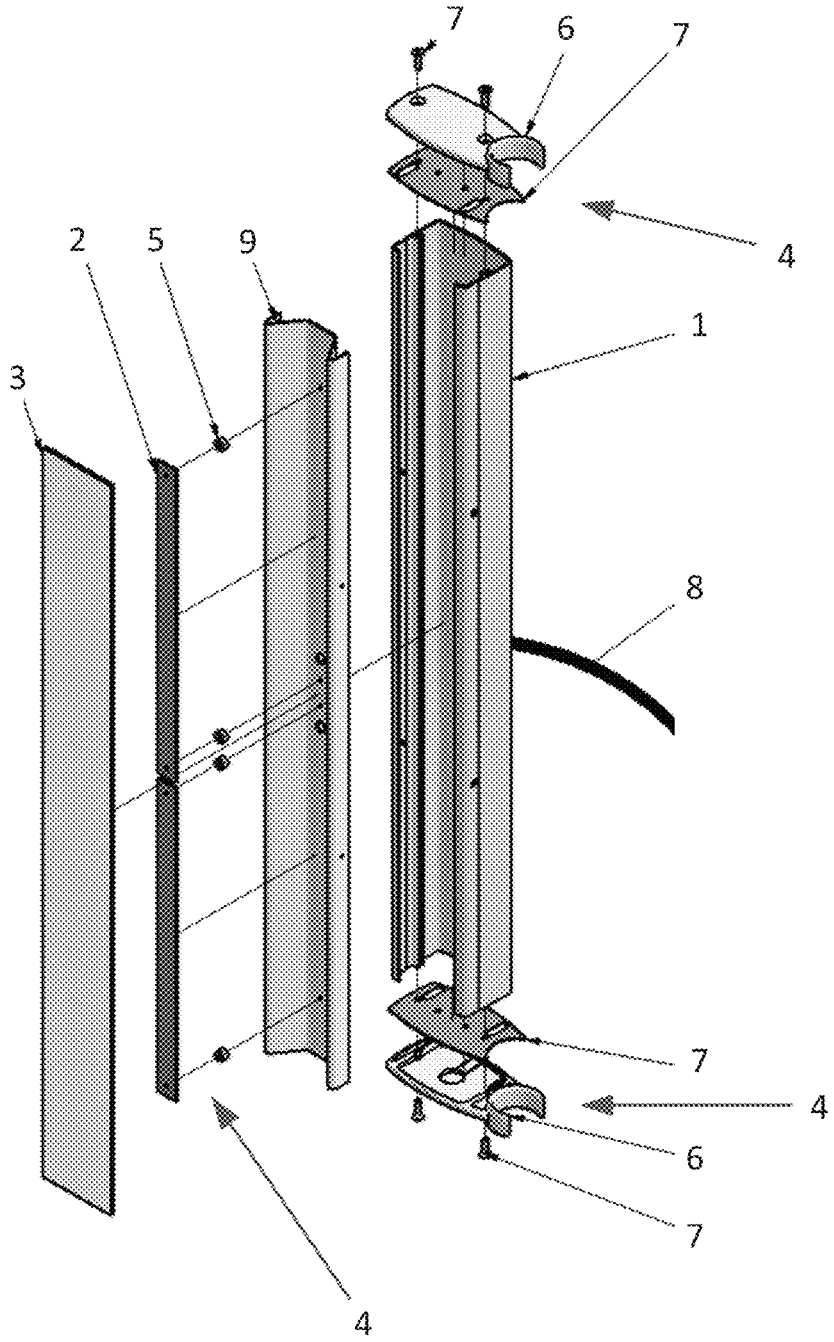
FIG. 10 shows an exploded view of the lighting device shown in FIG. 9.

FIGS. 8-10 show a third embodiment of a retrofitable lighting device 10 according to the invention for direct lighting a tray or a device on the supply console K, respectively. Thus, direct lighting of the immediate surrounding of the supply console (trays, ME-devices, etc.) is achieved without any disturbing lighting in the entire darkened room. The lighting device 10 is constructed such that it generates a direct lighting with one or several illuminants 2, using an internal or external electrical voltage supply (line current or accumulators, respectively), wherein the direct lighting can ensure a lighting of extensions of the supply console K.

The rack or light housing 1, respectively, serves as a base for the direct lighting device 10. The design of which can be made, for example, from plastic as an extruded section. A reflecting body 9 is installed within the light housing 1 having the function to house the illuminants 2. The light intensity of the lighting device 10 can be provided with a varying amount and arrangement of illuminants according to the required lighting conditions.

The light housing 1 is closed with a cover 3 which can be selectively slit in or can be fixed with fixing screws 4, respectively. Again, the cover 3 fulfills the above-mentioned two objects. The primary object is the reduction of the light intensity for generating a direct light. For this purpose, clouded plates with different grades of transmission or plates applied with a grid structure for a scattered lighting can be used, respectively.

Alternatively, the light intensity of the lighting device 10 can be regulated with a potentiometer. The fixing means 4 comprises two clips or connecting members 6 of the retrofitable direct lighting and the supply console, and is constructively designed such that the indirect lighting device can be mounted to the supply console with a "click". This kind of attachment allows the user to adjust or mount the retrofitable lighting device 10 at different positions; e.g. the lighting device 10 is movable in directions V along the rod S or is rotatable in directions R around a longitudinal axis of the rod, respectively. Thus, the user or the medical staff can change the orientation of the lighting by manual manipulation (i.e. by hand), as desired. The fixing material 7 serves for installing or assembling of the device 10, respectively.

In the present embodiment, the illuminants 2 comprise a number of several lighting elements (e.g. 72 LEDs) which are connected in series in two strips and which generate a light intensity of 144 lumen. Again, the angle of radiation in the present case is approximately 120° and the chromaticity coordinate is X 0.29 Y 0.31. The voltage supply of the retrofitable direct lighting device 10 is ensured by an electrical connection line 8 which can be created by means of a plug-in coupling X on the supply console K.

The ceiling and floor lighting devices 10 of FIGS. 1-7, as well as the lighting device 10 of FIGS. 8-10 can be provided with an electrical voltage supply in the form of accumulators (i.e. batteries) which are positioned within the housing or on the rack 1, respectively (for example, below the cover 3 adjacent to the illuminants 2). Alternatively or additionally, each lighting device 10 may comprise a line current connection line which can be connected to the current supply of the support system T.

It is the aim of the above description to illustrate the functioning of preferred embodiments of the invention, but not to limit the scope of the invention. Based on the above explanations, many variations will be obvious for those skilled in the art, which variations are comprised by the disclosure of the present invention.

The invention claimed is:

1. A lighting device, comprising:
a light rack for carrying an illuminant,
at least one illuminant attached to the light rack,
a light cover for covering the illuminant,
a medical device support system, and
a supply console to medically-technically supply medical-electrical end devices for treating a patient in a medical treatment room,
one or more medical-electrical end devices, held by the supply console, for treating the patient in the medical treatment room,
fixing means for fixing the light rack to one of the medical device support system and the supply console,
wherein the light rack is designed to be retrofit on a substantially horizontal upper surface of one of the medical device support system and the supply console, the medical device support system and the supply console having been previously installed in the medical treatment room, the upper surface facing a ceiling to direct light from the at least one illuminant upward toward the ceiling to serve as ceiling lighting.

2. The lighting device of claim 1, wherein the at least one illuminant and the light cover are designed for generating a lighting with an angle of radiation of less than approximately 180°.

3. The lighting device of claim 2, wherein the at least one illuminant and the light cover are designed for generating a lighting with an angle of radiation of approximately 120°.

4. The lighting device of claim 1, wherein the light rack has a flat profile and wherein an assembly of the light rack, the at least one illuminant, and the light cover has a flat profile.

5. The lighting device of claim 4, wherein the light rack includes a reflecting surface.

6. The lighting device of claim 1, wherein the light cover has a flat profile and extends over a substantial circumference of the at least one illuminant, and wherein the light cover consists of a substantially translucent material.

7. The lighting device of claim 6, wherein the light cover extends over a substantial circumference of the light rack.

8. The lighting device of claim 1, wherein the at least one illuminant comprises a light-emitting diode.

9. The lighting device of claim 8, wherein the at least one illuminant comprises a plurality of light-emitting diodes arranged in a flat profile on a flexible, rollable strip of material.

10. The lighting device of claim 1, further comprising a control unit allowing control of a light intensity of the lighting device.

11. The lighting device of claim 10, wherein the control unit is housed within an operating module, the operating module being integrated with the light rack.

12. The lighting device of claim 10, wherein the control unit comprises a potentiometer.

13. The lighting device of claim 10, wherein the control unit is housed within a remote control.

14. A lighting device, comprising:
a housing for carrying an illuminant,
an illuminant attached to the housing,
a cover for covering the illuminant, and
fixing means for fixing the lighting device to a supply console for medically-technically supplying medical-electrical end devices for treating a patient in a medical treatment room,
wherein the fixing means comprises a clip for releasable fixation of the lighting device to a cylindrical component of the supply console, and wherein the lighting device is rotatable in a first direction around the cylindrical component and movable in a second direction along the cylindrical component.

15. The lighting device of claim 14, wherein the clip has elastically stretchable grippers which, at least partially, encompass the cylindrical component.

16. An apparatus comprising:
a supply console to medically-technically supply medical-electrical end devices for treating a patient in a medical treatment room; and
a lighting device fixed to the supply console, wherein the lighting device includes:

a light rack for carrying an illuminant, at least one illuminant attached to the light rack, a light cover for covering the illuminant, and fixing means for fixing the light rack to the supply console, whereby the fixing means comprises a clip for releasable fixation of the lighting device to a cylindrical component of the supply console, and wherein the lighting device is rotatable in a first direction around the cylindrical component and movable in a second direction along the cylindrical component.

17. A supply console for medical-electrical devices, wherein the supply console has a retrofitable lighting device, wherein the retrofitable lighting device comprises:

a light rack for carrying an illuminant, at least one illuminant attached to the light rack, a light cover for covering the illuminant, and fixing means for fixing the light rack to the supply console, wherein an assembly of the light rack, the at least one illuminant, and the light cover generates a flat profile for the lighting device, wherein the lighting device is designed for being retrofitted on a substantially horizontal upper surface of the supply console, the upper surface facing a ceiling to direct light from the at least one illuminant upward toward the ceiling to serve as ceiling lighting, and wherein the supply console is configured for integrated arrangement of the retrofitable lighting device in the supply console.

* * * * *